United States Patent [19]

Mori et al.

[11] Patent Number: 4,711,103

[45] Date of Patent: Dec. 8, 1987

[54] CONTROLLING DEVICE FOR CLOTHES WASHING MACHINE

[75] Inventors: Maurizio Mori; Piero Babuin, both of Pordenone; Giuseppe Cargnel, Treviso, all of Italy

[73] Assignee: Zanussi Elettrodomestici S.p.A., Pordenone, Italy

[21] Appl. No.: 862,801

[22] Filed: May 13, 1986

[30] Foreign Application Priority Data

May 24, 1985 [IT] Italy ..... 45715 A/85

[51] Int. Cl.[4] ..... D06F 33/02

[52] U.S. Cl. ..... 68/12 R; 68/16; 68/18 F

[58] Field of Search ..... 68/12 R, 16, 18 F, 58, 68/207

[56] References Cited

U.S. PATENT DOCUMENTS

| | | | |
|---|---|---|---|
| 2,279,656 | 4/1942 | Chamberlin et al. | 68/16 |
| 2,892,334 | 6/1959 | Gray, Jr. | 68/12 R |
| 2,914,935 | 12/1959 | Sampsel | 68/12 R |
| 3,197,980 | 8/1965 | Marple | 68/12 R |
| 3,220,228 | 11/1965 | Low | 68/12 R |
| 4,580,421 | 4/1986 | Babuin et al. | 68/12 R |

FOREIGN PATENT DOCUMENTS

| | | | |
|---|---|---|---|
| 10577 | 1/1979 | Japan | 68/207 |
| 152358 | 11/1979 | Japan | 68/12 R |

*Primary Examiner*—Philip R. Coe

*Attorney, Agent, or Firm*—Wenderoth, Lind & Ponack

[57] ABSTRACT

A controlling device controls the operation of a clothes washing machine having a tub, a washing liquid collector, a heating element and two thermostats within the collector, and an electric pump for circulating the washing liquid from the collector to the tub. Three pressostats or pressure switches allow washing liquid to be filled to two different levels in the machine and for controlling the working condition of a filtering element within the collector. The controlling device allows both "intensive" washing programs with only a low level of liquid in the collector and "delicate" washing programs with normal levels of liquid in the tub. Different types of laundry can be washed under the best conditions with low consumption of water, detergents and electric power.

7 Claims, 2 Drawing Figures

MT
BV
R
PR
PS
AV

CONTROLLING DEVICE FOR CLOTHES WASHING MACHINE

BACKGROUND OF THE INVENTION

The present invention relates to a controlling device for a laundry washing machine of a type in which clothes are washed through spraying washing liquid onto the laundry or clothes.

In U.S. patent application Ser. No. 677,302, filed Dec. 3, 1984, and now U.S. Pat. No. 4,580,421, there is disclosed a laundry washing machine of the above type which includes a washing tub, a laundry containing drum and a collector for the wash liquor or liquid positioned beneath and connected with the washing tub, the collector being so shaped as to contain at least a filtering element, an electric heating element and a thermostatic sensor for respectively filtering, heating and sensing the temperature of the wash liquor.

The wash liquor collector is connected both with outlet piping of the washing machine through a usual drain pump, and with the wash tub through a further piping system and an electric circulating pump, which can be either separate from or on the same axis with the drain pump, the electric circulating pump being provided with a suction opening connected with the wash liquor collector as well as a delivery opening connected with the further piping system.

Such a machine allows therefor for performing both "intensive" and "delicate" washing programs of a traditional type for washing heavily soiled clothes at normal levels of the wash liquor in the tub, while keeping the circulating pump switched off for the entire duration of such washing programs, as well as "intensive" washing programs for laundering not so heavily soiled clothes at lower levels of the wash liquor in the tub and switching on the circulating pump during certain periods during such washing programs in such a way that the wash liquor is repeatedly circulated from the collector into the tub through the piping system and is directly sprayed onto the clothes.

In particular, these special "intensive" washing programs are used to wash not so heavily soiled cottons and/or heat-resistant synthetics by filling the wash liquor into the collector at different reduced levels according to the actual wash load in the drum.

Such special programs do not include pre-soak or pre-wash cycles of the type usually available in traditional "intensive" to "delicate" washing programs, but only a suitable sequence of washing steps in which the circulating pump is constantly kept under a switched-on condition and the wash liquor is heated up to maximum temperatures of approximately 90° C., while the drum is rotated both at wash speed with a reversing action, and at spin-extraction speed for shorter time spans than at the regular wash speed. At the end of the actual washing process, the wash liquor is discharged under a switched-off condition of the recirculating pump. Thereafter, a sequence of regular rinse cycles is performed in a traditional way. As a result, these "intensive" washing programs, owing to the reduced levels of wash liquor used in the tub, can be performed with substantial savings of water, detergents and energy as compared with traditional programs.

However, while operating satisfactorily and reliably, such a washing machine has some drawbacks.

A first drawback involves limitations in the applicability of washing programs involving reduced levels of the wash liquor in the tub. In particular, such programs are not applicable to the washing of clothes with special kinds of soils, such as some proteinic or organic soils (blood, cocoa, milk, etc.), mud and similar soils, which require that the wash liquor be heated up to low temperatures (approximately 40° C.) and duly kept to such temperature values for fixed periods of time in order to prevent soil from fixing onto the clothes. As a matter of fact, in such a case, due to the reduced amount of water that is being filled into the tub, the wash liquor would be heated up very quickly, thus preventing the lower temperature values from being maintained for a suitable period of time as required for best washing results. In other words, clothes with such particular soils would be washed at higher than optimal temperatures and this would inevitably lead to unsatisfactory washing results.

Furthermore, the above mentioned washing programs would only give satisfactory washing results when laundering cottons and/or heat-resistant synthetics which are not so heavily soiled and do not, therefore, require a pre-soak or pre-wash cycle in order to completely remove soil.

Also, such washing programs would not lead to satisfactory results even when laundering clothes of the type mentioned above if they are heavily soiled and therefore require a preliminary soak or pre-wash cycle for adequate soil removal, since the programs are not designed to include such a pre-soak or pre-wash cycle.

Further drawbacks in the use of this washing machine derive from the absence of suitable safety devices to check both the filtering element for efficiency and the heating element for safe operation, i.e. to make sure that the latter only operates when actually flooded with wash liquor. As a matter of fact, in the first case, since the filtering element is designed to retain soil particles from the wash liquor being circulated from the appropriate collector to the machine tube through the proper recirculation pipe, there is the actual need for constantly checking the filtering element in order to immediately sense an irregular condition, e.g. clogging, and to enable the user to clean or possibly replace the filtering element for ensuring a constantly effective circulation of the wash liquor. In the second case, the heating element must always be flooded, i.e. submerged in the wash liquor, to ensure its correct and safe operation, or else it will overheat to excessive temperature values, thereby risking damage to the element itself and the washing machine.

SUMMARY OF THE INVENTION

The object of the present invention, therefore, is to overcome all of the above mentioned drawbacks and limitations in a washing machine of the type described above, but provided with a special controlling device designed to allow programs at low levels of the wash liquor in the tub to be performed for washing any type of more or less soiled clothes or laundry, except for particularly delicate fabrics and knitware (woolens, silks, acrylics) requiring washing at regular levels of the wash liquor in the tub in all cases.

This controlling device is further provided with safety devices for checking the efficiency and the operating conditions of both the filtering element and the heating element of the washing machine, in order to prevent disturbances of the afore mentioned type from occurring.

These and other objects are achieved according to the present invention by the provision of a controlling device for a clothes or laundry washing machine of the type including a tub, a rotatable drum within the tub and a wash liquor collector communicating with a lower side of the tub through a flexible conduit and with an upper side of the tub through a pipe and a circulating pump, the collector housing at least a filtering element, an electric heating element and thermostatic temperature control means, the washing machine further including an inlet solenoid valve and level control means for the wash liquor. The temperature control means comprise at least a first and a second thermostat, or the like, which are calibrated at a fixed tripping temperature and at adjustable tripping temperatures, respectively. Furthermore, the level control means comprise first and second pressure switches, or the like, which are selectively connectable with the solenoid valve and are so calibrated as to determine that the wash liquor is fed to a predetermined level in the tub and to a lower level in the collector. The level control means further includes a third pressure switch, or the like, which is connectable with both the first and second pressure switches and calibrated so as to detect the pressure of the wash liquor circulating upstream of the filtering element. The first and second pressure switches also are selectively connectable to the heating element, in parallel with the circulating pump, through the first and second thermostats. At least one control relay is energized or de-energized to cause cams of a program unit and associated with various electrical contacts of the controlling device to stop or to progress, respectively, thereby energizing or de-energizing various of the electric components of the machine.

BRIEF DESCRIPTION OF THE DRAWINGS

Other objects, features and advantages of the present invention will become more apparent from the following description, serving merely as a non-limiting example, with reference to the accompanying drawings, wherein.

DETAILED DESCRIPTION OF THE INVENTION

Figure 1:
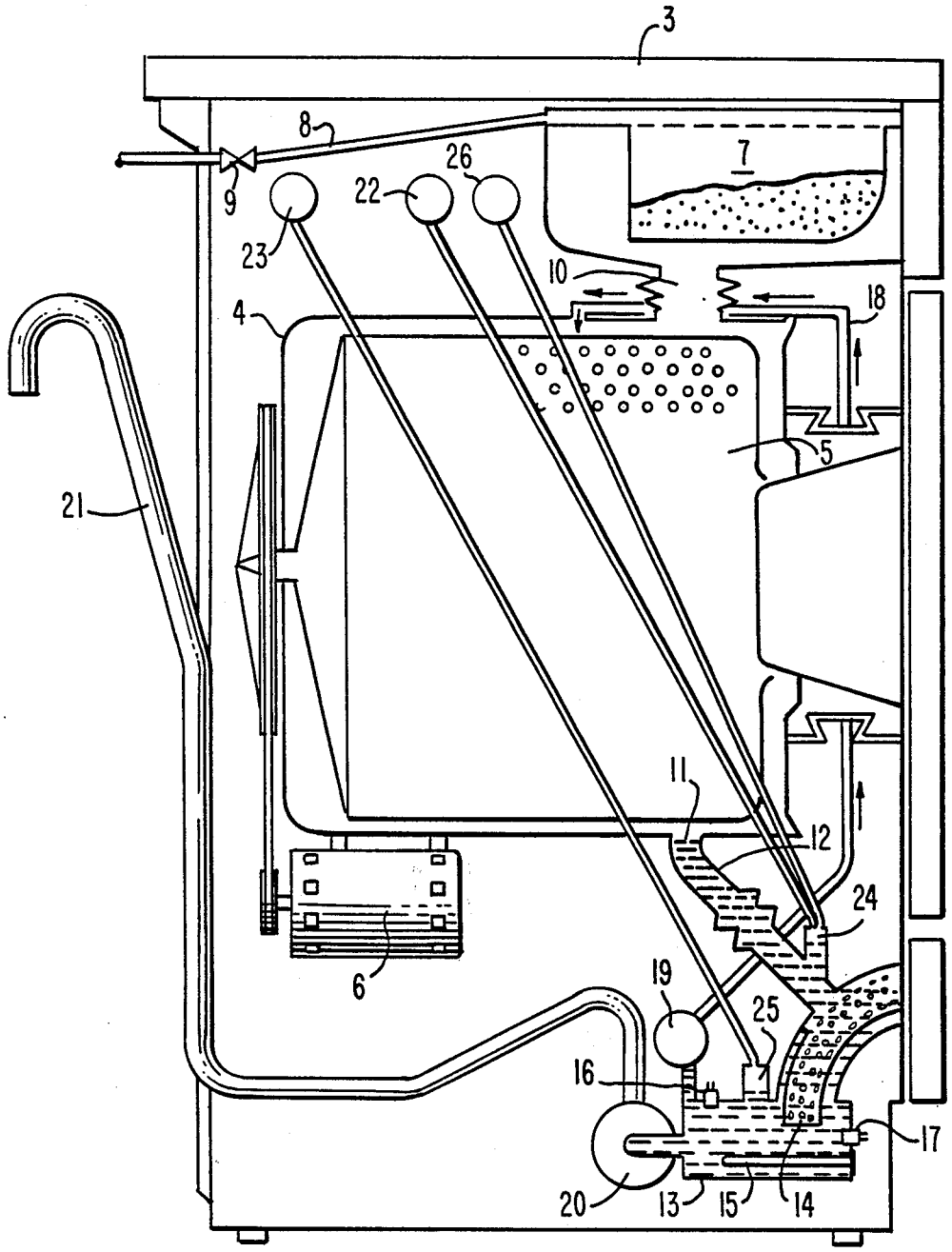
FIG. 1 is a diagrammatic and partially sectional side view of a laundry washing machine provided with a controlling device according to the invention.

With reference to FIG. 1, a clothes or laundry washing machine provided with a controlling device according to the invention is shown. The machine essentially includes a cabinet or housing 3, a wash tub 4 supported within housing 3 in a per se known manner, and a drum 5 designed to contain the washload and rotated by an electric driving motor 6 of a traditional type, which is attached to the lower part of the tub 4. Furthermore, on the upper part of the machine there is a detergent dispenser 7 for washing and rinsing agents, which is connected to a water supply through a suitable pipe 8 and a solenoid valve 9 and a hose 10 connecting dispenser 7 with the tub 4, and through which water and detergents flow into the tub.

The lower part of the tub 4 is provided with a drain opening 11 which is connected through a hose 12 with a collector 13 designed to collect the wash liquor from tub 4. Collector 13 contains a fine-mesh filtering element 14 of a known type placed in a removable manner within collector 13 so as to be in the stream of the wash liquor flowing from tub 4, thereby to retain all soil particles from the liquor during pre-wash and main wash operations, as described in the following.

Furthermore, at least an electric heating element 15 and two thermostats 16 and 17, or similar temperature sensors, of a traditional type are located within collector 13 and are designed respectively to heat and control the temperature of the in-flowing wash liquor.

In particular, the heating element 15 is sized so as to ensure an adequate power output for a rather rapid heating up of the wash liquor, and further it can be energized for different lengths of time, as described in the following, through proper control by the thermostat 16 or the thermostat 17.

The thermostat 17 on the contrary is of an adjustable type, and is calibrated for a variable temperature range, i.e. preferably from approximately 30° C. and 90° C., in order to allow the wash liquor to be heated up to different temperature values, according to the type or requirements of the washload, during the wash cycle.

Furthermore, the wash liquor collector 13 is connected with the upper part of the tub 4 through a pipe 18, which is attached to the upper part of the collector itself, and an electric circulating pump 19, so as to bring about a continuous circulation of the wash liquor from the collector 13 to the tub 4 during the different washing programs performed by the clothes washing machine.

Finally, wash liquor collector 13 also is connected through a drain pump 20 with a drain hose 21 to discharge the wash liquor from the collector into a drain at the end of the washing program.

The washing machine designed in this way is substantially similar to the one described in U.S. patent application Ser. No. 667,302, where the operational features and the further possible embodiments of the machine itself are also described, and the disclosure of which herein is incorporated by reference.

In order to achieve a suitable control of the level of the liquor flowing into the washing machine, the latter is provided with two pressure switches 22 and 23, or similar level control devices, which are connected to air traps 24 and 25, respectively, provided in the hose 12 and in the upper part of the collector 13. In particular, the pressure switch 22 is set to determine and achieve a fixed, normal level of the wash liquor filled into the tub 4 for carrying out "delicate" laundering programs to wash woolens, silks or delicate synthetics, or even single soak and pre-wash cycles associated with "intensive" laundering programs for washing more or less heavily soiled cottons, linens and/or heat-resistant synthetics, in a manner described below. The pressure switch 23 is set to determine and achieve a minimum level of the wash liquor flowing into the collector 13, which minimum level is lower than that achieved by the pressure switch 22, remains unaltered for any quantity and type of clothes loaded into the drum 5, and also is sufficiently high to ensure complete submersion of the heating element 15 in the wash liquor. The purpose of pressure switch 23 is to allow "intensive" laundering programs to be performed for washing more or less heavily soiled cottons, linens and/or heat-resistant synthetics in a manner described below.

Furthermore, the clothes washing machine herein considered is provided with another pressure switch or similar level control device 26 which also is connected to the air trap 24 and is set so as to sensitively react to pressure variations occurring in the hose 12 when the wash liquor is being circulated through the conduits 12 and 18 and the filtering element 14 by the action of the recirculation pump 19. The purpose of pressure switch 26 is to constantly sense the pressure of the wash liquor flowing through the flexible conduit 12, upstream of the filtering element 14 with respect to the direction of flow of the wash liquor, thereby to indirectly check the efficiency conditions of filtering element 14, since pressure switch 26 will sense and immediately indicate any irregular condition resulting from the filtering element becoming clogged with dirt or soil particles retained from the wash liquor. In this way, the pressure switch 26 changes between two operating settings, according to the efficiency condition of the filtering element. In particular, pressure switch 26 will stay in a first operating setting as long as it senses a certain flow pressure in the flexible conduit 12 corresponding to a condition in which filtering element 14 is completely free of clogging or is clogged only to such a minimum extent that an efficient circulation of the wash liquor is not impaired. The pressure switch 26 will then change over to a second operating setting as soon as it senses a different pressure in the flexible conduit 12, higher than the previous pressure, due to the filtering element 14 becoming clogged to such an extent as to preclude any further efficient circulation of the wash liquor. This second operating setting of the pressure switch 26 is indicated by an optical display or an acoustic signal, as will be described below, to alert the user that the filtering element 14 needs cleaning or possibly replacing.

This invention also considers the possibility of combining the afore mentioned pressure switches so as to obtain, for example, a single level control unit comprising a combination of the three pressure switches 22, 23 and 26, or even a level control pair comprising a combination of the two pressure switches 22 and 26 and a separate assembly of the remaining pressure switch 23.

Figure 2:
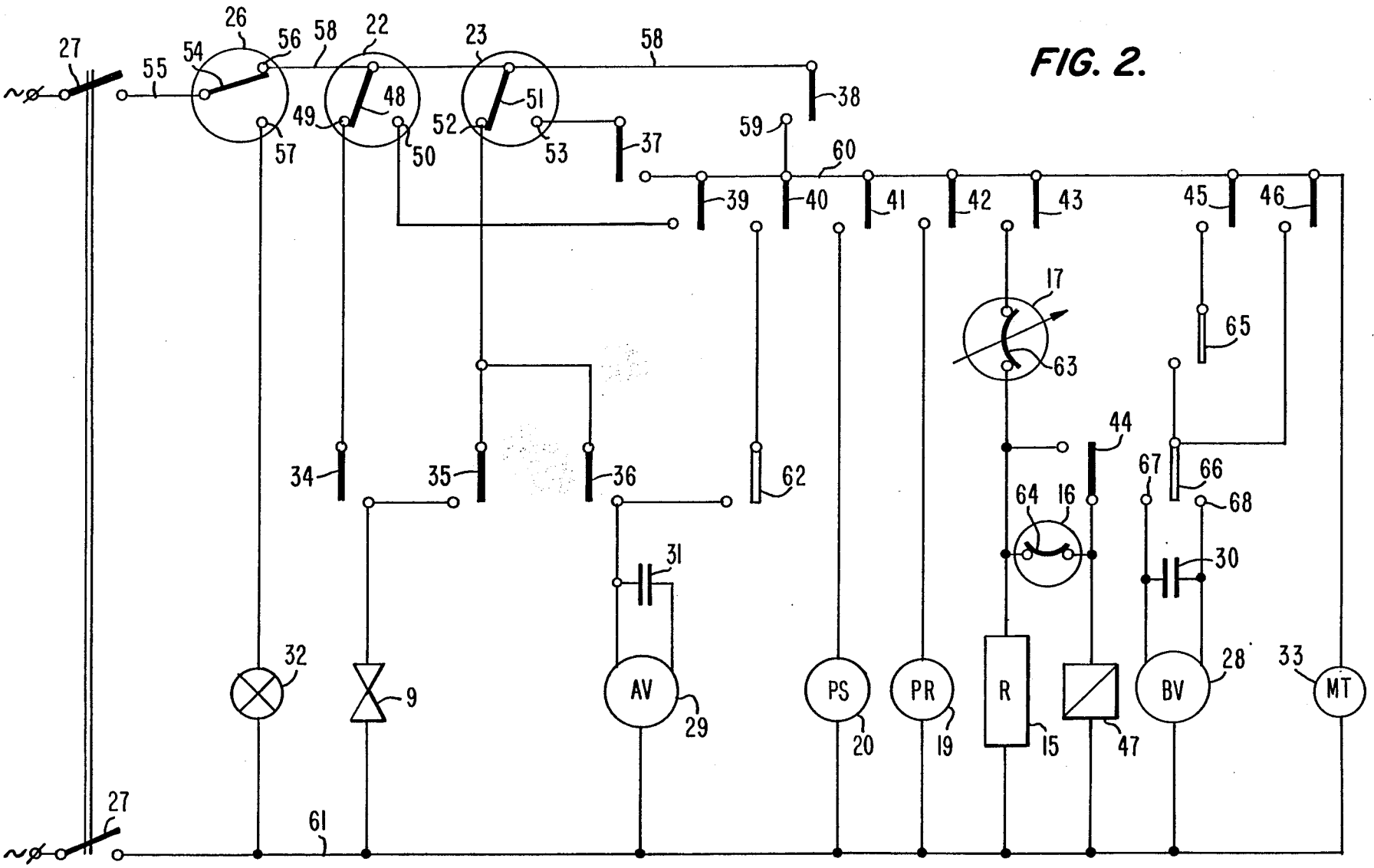
FIG. 2 is an electric circuit diagram of the controlling device according to the invention.

With reference to FIG. 2, an electric circuit diagram of the main controlling device for the washing machine according to the invention is shown, where it can be seen that the device is connected to a power supply source through a main on/off switch 27 and essentially comprises, in addition to the pressure switches 22, 23 and 26 and all other components mentioned above, also electrical windings 28 and 29 of the motor 6, which respectively are designed to bring about the low wash speed and the high spin speed of the motor, such windings being connected with corresponding start capacitors 30 and 31.

The controlling device for the washing machine also comprises an indicator light 32 designed to alert the user of a possible clogged condition of the filtering element 14, a motor 33 intended for rotating a cam cylinder for operating cams associated with a set of electrical contacts 34–46 which are provided for selectively switching on and off the various electrical components of the washing machine, and a control relay 47 or similar device designed to cause such cams to stop or to further rotate depending on whether the relay is energized or de-energized. One skilled in the art would understand the construction of such cam cylinder and the association thereof with such contacts.

The pressure switch 22 is provided with a moving electrical contact 48 which can switch between two different operating settings, i.e. to either of two fixed contacts 49 or 50, as a function of the level of the wash liquor filled into the tub 4. In particular, moving contact 48 switches over to fixed contact 49 ("empty" tub) whenever the tub 4 is empty or filled with wash liquor to a level which is lower than a regular or predetermined level. On the contrary, moving contact 48 switches over to fixed contact 50 ("full" tub) whenever the regular level of the wash liquor is reached in the tub 4.

Similarly, the pressure switch 23 is provided with a moving electrical contact 51 which can switch between two different control settings, i.e. to either of two fixed contacts 52 or 53, as a function of the level reached by the wash liquor filled into the collector 13. In particular, moving contact 51 switches over to fixed contact 52 ("empty" collector) when the collector 13 is empty or filled with wash liquor to a level which is lower than a minimum regular or predetermined level. On the contrary, moving contact 51 switches over to fixed contact 53 ("full" collector) when the collector 13 is filled with wash liquor to the minimum regular level.

Finally, the remaining pressure switch 26 is provided with a moving electrical contact 54, which can be connected to the power supply through a main conductor 44 and the on/off switch 27, moving contact 54 switching between either of two fixed contacts 56 or 57 depending on the pressure switch 26 being at its first or second operating setting, respectively, as described above. In the first case, moving contact 54 causes the energization of a common conductor 58 which is connected with both the corresponding moving contacts 48 and 51 of the pressure switches 22 and 23 and the electrical contact 38 which is capable of switching over to a further fixed contact 59 connected with a further common conductor 60. In the second case, moving contact 54 causes the energization of the indicator light 32 which is connected with the fixed contact 57 of the pressure switch 26 and a main or common conductor 61 of the controlling device.

The fixed contacts 49 and 50 of the pressure switch 22 can be connected, through corresponding electrical contacts 34 and 39 of the controlling device, respectively, with the solenoid valve 9 and the mentioned main conductor 61, and with the common conductor 60.

Similarly, the fixed contacts 52 and 53 of the pressure switch 23 can be connected, through corresponding electrical contacts 35 and 37 of the controlling device, respectively with the solenoid valve 9 and the main conductor 61, and with the common conductor 60.

Functional connections that can be achieved with the remaining contacts of the controlling device will be described hereinafter.

In particular, the contact 40 can close to make a circuit comprising an inverter switch 62, which is actuated by the continuous rotation of the cams of the controlling device and which can be connected in series with the electrical winding 29 for the high spin speed of the motor 6, winding 29 being connected with the main conductor 61. As an alternative, electrical winding 29 can also be energized through the contact 36, which is directly connected with the fixed contact 52 of the pressure switch 23, rather than through the above mentioned inverter switch 62.

The contacts 41 and 42 can to closed to activate the drain pump 20 and the circulation pump 19, respectively, both such pumps being connected with the main conductor 61. Similarly, the contact 43 can close to form a circuit comprising the adjustable thermostat 17 connected in series with the heating element 16 to the main conductor 61. Heating element 15 can be parallel-connected with a further circuit comprising the fixed thermostat 16 in series with the control relay 47, fixed thermostat 16 further being short-circuitable through the closure of the contact 44, which is parallel-connected with thermostat 16. The thermostats 16 and 17 are provided with corresponding contacts 64 and 63 of the normally closed type, which therefore open when the rated tripping temperatures for the respective thermostats are reached. Of course, according to the invention it is also possible to use thermostats having contacts of the normally open type, by connecting them in a different way with the heating element 15 and the relay 47, provided that the heating of the wash liquor can in both cases be controlled according to the form and procedure described hereinafter.

The remaining electrical contacts 45 and 46 of the controlling device each can energize electrical winding 28 for the low wash speed of the motor 6, winding 28 being connected with the main conductor 61. In particular, the contact 45 can be connected with electrical winding 28 through two further inverter switches 65 and 66, both associated with a corresponding cam of the controlling device, of which the inverter switch 66 can be switched over to close either of fixed contacts 67 and 68 connected with electrical winding 28, in order to cause the driving motor 6 to rotate in opposite directions according to a reversing motion sequence. The contact 46, on the other hand, can be connected with electrical winding 28 directly through the inverter switch 66. The purpose of contacts 45 and 46 is to enable the drum 5 to be rotated according to a reversing sequence and at two different rhythms of reversing motion, i.e. a "delicate" alternating rotation (i.e. with short motions) through the closure of the contact 45 and the energization of the inverter switches 65 and 66, and an "intensive" alternating rotation (i.e. with long motions) through the closure of the contact 46 and the energization of the inverter switch 66, in order to carry out the various washing programs as described hereinafter.

The drive motor 33 of the controlling device is directly connected with the common conductor 60 and the main conductor 61.

The various washing programs that can be controlled by the controlling device according to this invention now will be described in detail.

A pre-soak or pre-wash cycle selectively can be added to the program, before the main washing operation, in the case of heavily soiled clothes. If a pre-wash cycle is to be added, the thermostat 17 is set by hand to an appropriate control setting according to the nature or type of soil to be removed, at which setting the wash liquor is heated to a higher temperature than 40° C. Furthermore, the controlling device in this case is set by hand to an initial setting in which the moving contact 54 of the pressure switch 26 closes the fixed contact 56, while the moving contact 48 of the pressure switch 22 closes the fixed contact 49. The contacts 34 and 39 are connected with the solenoid valve 9 and the fixed contact 50 of the pressure switch 22, respectively, while the contact 43 closes the circuit comprising the heating element 15, both thermostats 16 and 17, as well as the relay 47, and the contact 46 is connected with the inverter switch 66. In this way, the wash liquor is filled into the tub 4 to a normal level as fixed by the pressure switch 22, and such liquor is then gradually heated while the rotating drum of the washing machine is driven at low wash speed according to an "intensive" reversing sequence. Subsequently, the contact 42 closes the circuit for circulation pump 19 for the entire duration of the period during which the wash liquor is heated. As a result, such wash liquor is circulated through the recirculation conduit 18, thereby ensuring its uniform heating inside the machine. In this way, since heating is achieved in the presence of a considerable quantity of wash liquor in the tub 4, the temperature of the liquor can rise only slowly. Furthermore, during such heating of the wash liquor the thermostat 16 is connected in series with the control relay 47, the resulting energization of which causes the cams of the controlling device to stop. In this way, an extended soak cycle at low temperatures is obtained for the clothes, which allows part of the soil to be removed from the clothes, and also prevents such soil from redepositing onto the clothes as it is subsequently discharged with the wash liquor.

As soon as a temperature of 40° C. of the wash liquor is reached, which is the value at which the thermostat 16 is rated to trip, the contact 64 of thermostat 16 opens, thus causing de-energization of the relay 47. As a result, the cams of the controlling device again start to rotate and their progress causes the contacts 38, 41 and 45 to close and the contacts 34, 43 and 46 to open. In this way, the contacts 41 and 45 become energized through the common conductor 58, 60 and the contact 38, and this activates the drain pump 20 and the low speed winding 28 of the motor 6, the latter through the inverter switches 65 and 66, causing the wash liquor to be drained from the tub 4 and the rotating drum 5 to be driven according to a "delicate" reversing sequence. Furthermore, the heating element 15 is de-energized by the opening of the contact 43. The contact 36 then activates the high speed windings 29 of the motor 6, while the contact 41 is kept closed on the drain pump 20. As a result, the drum 5 is rotated at a spin-extraction speed, while the wash liquor continues at the same time to be drained from the tub 4. The drum rotates at this spin-extraction speed for a relatively long period of time, until all of the wash liquor is discharged from the tub. In this way the pre-wash cycle is terminated.

Subsequently, at the beginning of the main wash cycle for the heavily soiled cottons and/or linens featuring such special soils as already described, the moving contact 54 of the pressure switch 26 is still set on the fixed contact 56, while the moving contact 51 of the pressure switch 23 switches over to the fixed contact 52. The contacts 35 and 37 are connected with the solenoid valve 9 and the fixed contact 53 of the pressure switch 23, respectively, while the contact 40 closes the circuit comprising the high speed winding 29 of the motor 6 through the inverter switch 62. With the controlling device set in this manner, the contact 42 closes the circulation pump 19, while the contact 45 closes on the low speed winding 28 of the motor 6 through the inverter switches 65 and 66. In this way, the wash liquor is filled into the collector 13 of the washing machine to a reduced level as determined by the pressure switch 23, while the drum 5 stands still.

Subsequently, while circulation pump 19 continues to be switched on, drum 5 is driven for long periods of time at the wash speed by the inverter switches 65 and 66 being energized, and for short periods at the spin-extraction speed owing to the energization of the inverter switch 62. While the contacts 37, 40, 42 and 45 are kept closed, the contact 43 is then closed on the circuit comprising the thermostats 16 and 17, as well as the heating element 15 and the relay 47. The energization of relay 47 then causes the cams of the controlling device to stop. As a result, the drum 5 and the circulation pump 19 are driven in the same manner as described above, while the wash liquor is being heated to the tripping temperature of the thermostat 16, i.e. 40° C. Then, as soon as the tripping temperature of the thermostat 16 is reached, the contact 64 of thermostat 16 opens and the resulting de-energization of the relay 47 causes the cams of the controlling device to start rotating again in the same way as described before. At this point, a wash period is carried out with the wash liquor maintained at a low temperature in order to ensure the effective removal of the particular soils and to prevent them from fixing onto the clothes. This wash period to remove such special soils can be also performed in a manner differing from that described above, in that a period can be provided at the beginning of the main wash cycle during which the drum 5 and the circulation pump 19 are driven as in the previous cycle, but with no initial heating of the wash liquor, in order to have the wash liquor sprayed unheated onto the clothes. Then, after such a fixed period of time as to equally ensure the effective removal of the special type of soil from the clothes, this first period is terminated, while the next one is started.

While the contacts 35, 37, 40, 42 and 45 are still switched to their corresponding closed settings, as described above, the contacts 43 and 44 also now are closed in order to bring about the energization of the heating element 15 which is parallel-connected with the circuit comprising the relay 47 in series with the contact 44, through the adjustable thermostat 17. The drum is still driven to alternately rotate at the wash speed and the spin-extraction speed, while the circulation pump 19 is constantly kept energized under the same conditions as described above. The thermostat 16 is short-circuited by the closure of the contact 44 and therefore, during this wash period, the heating of the wash liquor is controlled only through the adjustable thermostat 17. In this way, the relay 47 again causes the cams of the controlling device to stop and to further progress, as described above, as a function of whether or not the set temperature of the wash liquor is reached. As soon as the wash liquor is heated to the temperature that has been set through the adjustable thermostat 17, the contact 63 of thermostat 17 opens, thereby causing the relay 47 to de-energize and to allow the cams of the controlling device to rotate to a further control position, where the contacts 37, 40, 42 and 45 are maintained in their closed settings, while the contacts 43 and 44 opened. As a result, a wash step thereby is performed for a fixed period of time, starting from the previously reached temperature of the wash liquor and under no further heating of the wash liquor, while the drum and the circulation pump are driven in the same manner as previously described.

At the end of this wash step, during which the temperature of the wash liquor decreases very rapidly due to a reduced volume of the liquor, the contacts 43 and 44 close again, while the remaining contacts of the controlling device are maintained in the same condition as before. In this way, the heating element 15 and the relay 47 are again energized, thereby creating the same operating conditions as previously described. Also in this case, therefore, the temperature of the wash liquor is controlled by the thermostat 17, the on/off cycling of which causes the heating element 15 to repeatedly switch on and off in such a way as to maintain the temperature of the wash liquor within a close range of lower and upper limits.

Subsequently, the contacts 37, 40, 42, 43, 44 and 45 open, while the contacts 34, 39 and 46 close. In this setting, the moving contact 54 of the pressure switch 26 furthermore switches over to the fixed contact 56, while the moving contact 48 of the pressure switch 22 changes over to the fixed contact 49. As a result, a further quantity of cold water is filled into the tub 4, with no detergent addition, and this is added to the still warm liquor contained in the tub until the normal filling level is reached as controlled by the pressure switch 22. In this setting, the drum is standing still. As soon as the normal filling level of the wash liquor in the tub is reached, the moving contact 48 of the pressure switch 22 changes over to the fixed contact 53, thereby causing the drum to be driven to rotate at low wash speed according to an "intensive" reversing sequence. The addition of further cold water to the hot wash liquor contained in the tub allows the wash liquor and the clothes to be gradually cooled down, thereby preventing the clothes from unduly wrinkling and creasing during the subsequent rinses. Furthermore, owing to the fact that a rather large quantity of further water is filled into the tub, there also occurs a substantial dilution of the detergent solution in the wash liquor, so that the detergent can be removed partially from the clothes and the tub even before the actual rinsing sequence. Finally, the contacts 38, 41 and 45 close and the contacts 34, 39 and 46 open, so that the wash liquor is drained from the tub, while the drum is rotated at low speed according to a "delicate" reversing rhythm.

Rinse cycles are subsequently performed in a very traditional way. However, the number of rinse cycles performed in this case appears to be lower than the number of rinses usually required by washing machines of the current type, since the detergent contained in the wash liquor will have already been diluted and partially discharged at the end of the previous wash cycle. In this way, it is possible to obtain a satisfactory wash cycle featuring a shorter duration and an optimized number of rinses, compared with the cycle described in the above U.S. patent application Ser. No. 677,302 filed Dec. 3, 1984.

The controlling device considered herein also allows "intensive" wash programs to be performed for heavily soiled cottons and/or linens, feature types of soil differing from those mentioned above. In this case, however, since these types of soil do not require slow heating of the wash liquor as is the case for the special soils described above, these programs can be performed without any pre-wash or preliminary soak cycle, so that the controlling device described herein can be directly set at the beginning of the main wash sequence, while having the adjustable thermostat 17 set by hand to the required wash temperature according to the type or degree of soil to be removed. This main wash sequence then will be carried out in the same manner as previously described.

"Intensive" wash programs for not so heavily soiled cottons, linens and/or heat-resistant synthetics can be carried out by setting the controlling device at a wash step immediately following the step providing heating of the wash liquor to 40° C., which is designed to remove solids of a special nature as previously described, and by setting the adjustable thermostat 17 by hand at a wash temperature to be selected according to the soil to be removed. These programs are performed in much the same way as the above described "intensive" programs for heavily soiled clothes, but are shorter in that they include neither a pre-wash or preliminary soak cycle nor the main wash steps calling for heating of the wash liquor to 40° C.

The controlling device herein considered also allows "intensive" wash programs to be carried out for heat-resistant synthetics according to whether the clothes are heavily or not so heavily soiled. These "intensive" programs are set and carried out in much the same manner as the "intensive" programs previously described. Therefore, in this case pre-wash or pre-soak cycles also appropriately can be added if heavily soiled heat-resistant synthetics are to be washed by the removal of special soils of the type discussed above. However, as opposed to the previously described programs, these pre-wash or pre-soak cycles are carried out with the drum driven to rotate at a low wash speed according to a "delicate" reversing sequence, rather than an "intensive" reversing sequence as in the previous case. The subsequent main wash and rinse cycles of these "intensive" programs are then carried out in the same way and for the same purposes as in the previously described programs, except for the fact that throughout these cycles the drum never is rotated at a spin-extraction speed, the drum instead being driven to rotate at a low speed according to alternate "intensive" and "delicate" reversing sequences during the wash step involving heating of the wash liquor to 40° C.

The controlling device also allows "delicate" programs of a traditional type to be carried out for washing woolens, silks and delicate synthetics, such programs being performed at normal levels of the wash liquor in the machine through the energization of the pressure switch 22 and the circulation pump 19, the latter during the heating stages of the wash liquor.

The controlling device of the invention also includes safety devices for sensing the operating conditions of both the filtering element 14 and the heating element 15. In particular, as far as the filtering element 14 is concerned, it is necessary to immediately sense and indicate a condition in which the element appears to be excessively clogged by the soil particles and lint contained in the circulated wash liquor, in order to allow the user to clear or replace the filtering element, thereby ensuring a continued efficient circulation of the liquor itself. According to the invention, the operating conditions of the filtering element 14 are sensed by the pressure switch 26, which can be switched over to either of the two operating settings previously described. In the first of these settings the moving contact 54 of pressure switch 26 contacts fixed contact 56 and in the second of these settings moving contact 54 contacts the fixed contact 57.

As a result, in the first case, i.e. when the filtering element 14 is sensed to be unclogged or not appreciably clogged, all of the electrical contacts of the controlling device can be appropriately energized through the common conductors 58 and 60. The same applies to the various operating parts and components of the washing machine. However, in the second case, i.e. when filtering element 14 is sensed to be unduly clogged, the power supply to the electrical contacts of the controlling device, and therefore to the various operating parts and components of the washing machine, is interrupted, while the indicator light 32, or other appropriate optical, acoustic or similar signalling device, is energized in order to call the attention of the user on this irregular condition of the filtering element 14. As soon as this element is cleaned or replaced, as the case may be, the pressure switch 26 will then sense a lower flow pressure of the wash liquor circulating through the flexible conduit 12, so that the moving contact 54 of pressure switch 26 again contacts the fixed contact 56, thereby de-energizing the indicator lamp 32.

The safety device designed to sense the operating condition of the heating element 15 during the heating periods of the wash liquor when element 15 is energized is formed by the two thermostats 16 and 17 previously described. In particular, heating element 15 operates in a correct manner when it is entirely submerged in the wash liquor contained in the collector 13. In such a case, the heating element 15 will then be controlled by the thermostats 16 and 17 in the manner previously indicated. However, if heating element 15, due to failures occurring in the machine, happens to be only partially submerged in the wash liquor or to operate under dry conditions owing to the absence of wash liquor in the collector 13, element 15 will overheat very rapidly, and this would be likely to damage the heating element, as well as the clothes and the machine. According to the invention, in such case the heating element 15 immediately can be de-energized by the tripping of the thermostat 17, as soon as the element heats up to the rated tripping temperature thereof. As a result, this will safely prevent heating element 15 from overheating to any undesired extent.

The controlling device according to the present invention therefore allows clothes or other laundry to be washed both with "delicate" laundering programs of the traditional type, i.e. at normal levels of the wash liquor in the tub, and "intensive" laundering programs carried out at reduced levels of the wash liquor in the tub. These latter programs, in particular, allow washing of clothes featuring any type of soil, i.e. even the special soils previously indicated, at reduced water, detergent and power consumption values, compared with "intensive" programs performed by washing machines of the traditional type.

Such controlling device further can be set to carry out very short "intensive" programs for washing not so heavily soiled clothes, thus bringing about further water, detergent and power savings.

A further advantage of this controlling device derives from the fact that it allows for a lower number of rinse cycles to be carried out, for the above indicated reasons, thus reducing the duration of the wash programs involved as well as the overall water consumption.

Finally, owing to the presence of pressure switch 26 and the thermostats 16 and 17, such controlling device also provides for total safety by ensuring correct operation of both the filtering element 14 and the heating element 15.

Although the present invention has been described and illustrated with respect to preferred features thereof, it is to be understood that various modifications and changes may be made to the specifically described and illustrated features without departing from the scope of the present invention.

We claim:

1. In a controlling device for controlling the operation of a laundry washing machine of the type including a tub, a rotatable drum within said tub, a solenoid valve for controlling the introduction of washing liquid into said tub, a wash liquid collector communicating with a lower side of said tub through a flexible conduit and with an upper side of said tub through a pipe and a circulating pump for circulating washing liquid through said tub, a filtering element in said collector for filtering soil from the recirculated washing liquid, and an electric heating element in said collector for heating said recirculated washing liquid, said controlling device comprising thermostatic control means for controlling said heating element and level control means for controlling the level of said washing liquid, the improvement comprising:

said thermostatic control means comprising at least first and second thermostats calibrated at a fixed tripping temperature and at adjustable tripping temperatures, respectively;

said level control means comprising first and second pressure switches selectively connectable with said solenoid valve and calibrated to determine that the washing liquid is fed to a predetermined level in said tub and to a lower level in said collector and a third pressure switch connectable with both said first and second pressure switches and calibrated to detect the pressure of the washing liquid circulating upstream of said filtering element;

means for selectively connecting said first and second pressure switches to said heating element, in parallel with said circulating pump, through said first and second thermostats; and control relay means responsive to said first and second thermostats for controlling operation of a program unit of the laundry machine.

2. The improvement claimed in claim 1, wherein said first thermostat is connected in series with said control relay means and in parallel with said heating element, and said heating element is connected in series with said second thermostat.

3. The improvement claimed in claim 1, further comprising a contact connected in parallel with said first thermostat for short-circuiting said first thermostat.

4. The improvement claimed in claim 1, wherein said first and second thermostats are provided with respective normally closed tripping contacts.

5. The improvement claimed in claim 1, wherein said first and second pressure switches are mechanically connected with said flexible conduit and with the top of said collector, respectively, and include respective moving electrical contacts each of which is positionable in two different operating positions including a first position connected to said solenoid valve and a second position connected to said circulating pump, said heating element, said thermostats and said control relay means.

6. The improvement claimed in claim 5, wherein said third pressure switch is mechanically connected with said flexible conduit and includes a moving electric contact connected to a supply main and positionable in two positions including a first position connected to said moving contacts of said first and second pressure switches when said filtering element is free from dirt particles, and a second position connected to an indicator when said filtering element is clogged by dirt particles.

7. The improvement claimed in claim 6, wherein the washing further includes an electric motor for driving said drum and provided with first and second windings for a high spinning speed and a low washing speed, respectively, and further comprising an inverter switch intermittently energizing said low speed winding for alternating rotation of said drum, said high speed winding being energized by said moving contact of said second pressure switch selectively via a further inverter switch of a timer, for first intervals, when said moving contact of said second pressure switch is in said second position thereof, or via a further contact of said timer, for second intervals longer than said first intervals, when said moving contact of said second pressure switch is in said first position thereof.

* * * * *